US005826386A

United States Patent [19]

Casteel

[11] Patent Number: 5,826,386

[45] Date of Patent: Oct. 27, 1998

[54] STORAGE STRUCTURE WITH MEZZANINE ACCESS AND METHOD OF ASSEMBLY

[76] Inventor: Joseph M. Casteel, 255 Lylton Rd., Moon Township, Pa. 15108

[21] Appl. No.: 852,723

[22] Filed: May 7, 1997

[51] Int. Cl.[6] ..... E04H 6/34; E04B 1/348

[52] U.S. Cl. ..... 52/236.3; 52/73; 52/79.1

[58] Field of Search ..... 52/73, 79.3, 79.1, 52/33, 36.2, 36.1, 236.3

[56] References Cited

U.S. PATENT DOCUMENTS

| | | | |
|---|---|---|---|
| 3,803,778 | 4/1974 | Short | 52/33 |
| 3,818,654 | 6/1974 | Schramm | 52/73 X |
| 3,832,811 | 9/1974 | Briel, Jr. | 52/73 X |
| 4,073,100 | 2/1978 | Digiovanni, Jr. | 52/79.3 |
| 4,604,838 | 8/1986 | Remington et al. . | |
| 4,724,640 | 2/1988 | Patane | 52/236.3 X |
| 4,804,307 | 2/1989 | Motoda | 52/79.1 X |
| 4,882,883 | 11/1989 | Horn | 52/79.1 |
| 5,062,242 | 11/1991 | Corcoran | 52/36.1 |
| 5,072,554 | 12/1991 | Hayman | 52/79.1 |
| 5,140,787 | 8/1992 | Corcoran | 52/36.1 |

*Primary Examiner*—Christopher Kent
*Assistant Examiner*—Yvonne Horton-Richardson
*Attorney, Agent, or Firm*—Carothers and Carothers

[57] ABSTRACT

A modularly constructed storage structure with mezzanine access. The storage structure is provided in the form of a row of storage cabinets stacked on top of each other thereby providing base cabinets and upper storage cabinets. The storage cabinets have internal supporting structural framework which include vertical front and back beams and horizontal side beams with the frameworks of the stacked cabinets interconnected, and the vertical back beams of the base cabinets are also secured to an underlying supporting floor. The mezzanine structure, which is attached to the cabinet structure, includes a plurality of spaced horizontally aligned cantilever beams of predetermined length which penetrate the storage structure and are respectively connected directly or indirectly to front and back vertical beams of the cabinet structure. Overhang ends of these cantilever beams extend beyond the front face of the cabinet structure for cantilevered support thereon of a mezzanine deck. Decking is supported on these beams overhangs for mezzanine access to the upper storage cabinets. Since the mezzanine structure is entirely supported in cantilever fashion, no underlying vertical supports are required. A stairway may be attached as desired.

18 Claims, 6 Drawing Sheets

STORAGE STRUCTURE WITH MEZZANINE ACCESS AND METHOD OF ASSEMBLY

FIELD OF INVENTION

The present invention pertains to a modular storage structure in combination with a modular mezzanine structure for access to the storage structure. The storage structure generally consists of stacked modular steel cabinets and the mezzanine structure includes walkways, stairways, floor gratings, hand railings and associated structures which can be readily and conveniently secured to preexisting industry-standard storage or cabinet units.

BACKGROUND OF THE INVENTION

Numerous industrial storage systems have been developed and utilized over the years for efficient storage in warehouses, plants, etc. wherein storage space is at a premium. Industry standards for storage cabinets have been established so that, for example, cabinets comprising drawers of one manufacturer can be stacked or assembled with those of another manufacturer and door type cabinets can be readily stacked with drawer type cabinets.

In order to make the most efficient use of space, these cabinets are generally stacked to a height that requires access to upper levels of the storage system. Such access has in the past been normally provided by rolling stairs with casters or by a modularly assembled mezzanine structure.

The rolling stair structure which utilizes a flight of stairs mounted on casters is not particularly convenient as the stairs must be frequently moved from one location to another so as to not block access to lower storage cabinets or to provide access to upper storage cabinets.

Mezzanine structures are preferred. For example, see U.S. Pat. No. 4,604,838, issued Aug. 12, 1986 for Modular Mezzanine Structure for a Storage Facility and Method of Assembly.

Such mezzanine structures provide permanent stairways and platforms for accessing upper levels of the storage structures and they will support heavier loads and more than one individual at a time.

However, such present day mezzanine structures require either support columns, other support structure, or require that the mezzanine structure span two rows of cabinet structures for support on opposite sides. Underlying support columns are undesirable as they limit access to the storage structure underneath the mezzanine, and it is also expensive and not always desirable to be required to provide a second row of stacked cabinets in order to bridge or support the mezzanine structure on both sides between stacked cabinet structures.

In addition, required close spacing of cabinet rows to support such a mezzanine, or the inclusion of support columns under the mezzanine further limit use thereunder of equipment and machinery.

SUMMARY OF THE INVENTION

The storage structure with mezzanine access of the present invention includes a storage structure that utilizes a row of storage cabinets stacked on top of each other to a predetermined height, thereby providing base and upper storage cabinets. The storage cabinets have internal supporting structural framework, including vertical front and back beams and horizontal side beams. The cabinets and framework are generally constructed of steel, however, other elements may be substituted.

The frameworks of the respective stacked cabinets are interconnected and the vertical back beams of the base cabinets are secured to an underlying supporting floor, generally a concrete floor in an industrial plant or building.

The mezzanine is also modular in structure and has a plurality of spaced horizontally aligned cantilever beams of predetermined length that penetrate the storage structure. These cantilever beams are respectively connected to desired or selected of the front and back vertical beams of the cabinet storage structure and they extend beyond the vertical front beams or front face of the cabinet structure with overhangs for cantilevered support thereon of a mezzanine deck. Decking is supported on these beam overhangs for mezzanine access to the upper storage cabinets without the requirement of underlying support columns, adjacent supporting cabinets or any other supporting structure, thereby leaving all space underlying the mezzanine walkway free and clear as the mezzanine structure is fully supported from the storage structure in cantilever fashion.

The horizontal side beams of the cabinet structures generally include hollow metal beams, such as C-shaped steel channels, and the cantilever beams are received in or within selected ones of these hollow beams. These side hollow beams are generally provided as a pair of spaced side channels forming part of a pallet incorporated into each storage cabinet as a base and which thereby retain adjacent pairs of the cantilever beams with their overhangs protruding. Fasteners are utilized for securing the channels and coextending portions of the cantilever beams together.

The mezzanine decking is provided in modular sections which respectively span these adjacent pairs of cantilever beam overhangs. Toe rail channels are also provided and secured between distal ends of these adjacent pairs of cantilever beam overhangs.

The toe rail channels also support outer edges of the deck sections which rest on the toe rail channels. The toe rail channels may also include an upwardly extending lip or ledge which provides a coextending toe rail.

Opposite the toe rails, base rail supports for the decking are also provided. They are preferably formed in the form of S-shaped base rail channels secured between proximal ends of these adjacent pairs of cantilever beam overhangs and they support inner edges of the deck sections respectively within a channel of the S-shaped base rail channels.

A sectioned hand railing system having balusters is also provided with bottom portions of the balusters respectively interconnected with adjacent of the beam overhangs and toe rails between adjacent of the pairs of cantilever beam overhangs. This assists in rigidly tying the modular sections of mezzanine structure together in a solid unit.

Additional rigidity and support is provided to the cantilevered mezzanine structure by the addition of hand rails which span and are secured to upper portions of the balusters.

To additionally unify the modular mezzanine structure, adjacent proximal ends of the beam overhangs and the base rail channels between adjacent pairs of the overhangs are also interconnected.

A stairway is generally attached to the mezzanine structure for access from the supporting floor. The stairway may be attached to the mezzanine structure at any point desired, e.g., from the ends or side of the mezzanine structure and outwardly therefrom in any direction desired or required.

BRIEF DESCRIPTION OF THE DRAWINGS

Other objects and advantages appear hereinafter in the following description and claims. The accompanying drawings show for the purpose of illustration, without limiting the scope of the appended claims, certain practical embodiments of the present invention wherein:

DETAILED DESCRIPTION OF A PREFERRED EMBODIMENT

Figure 1:
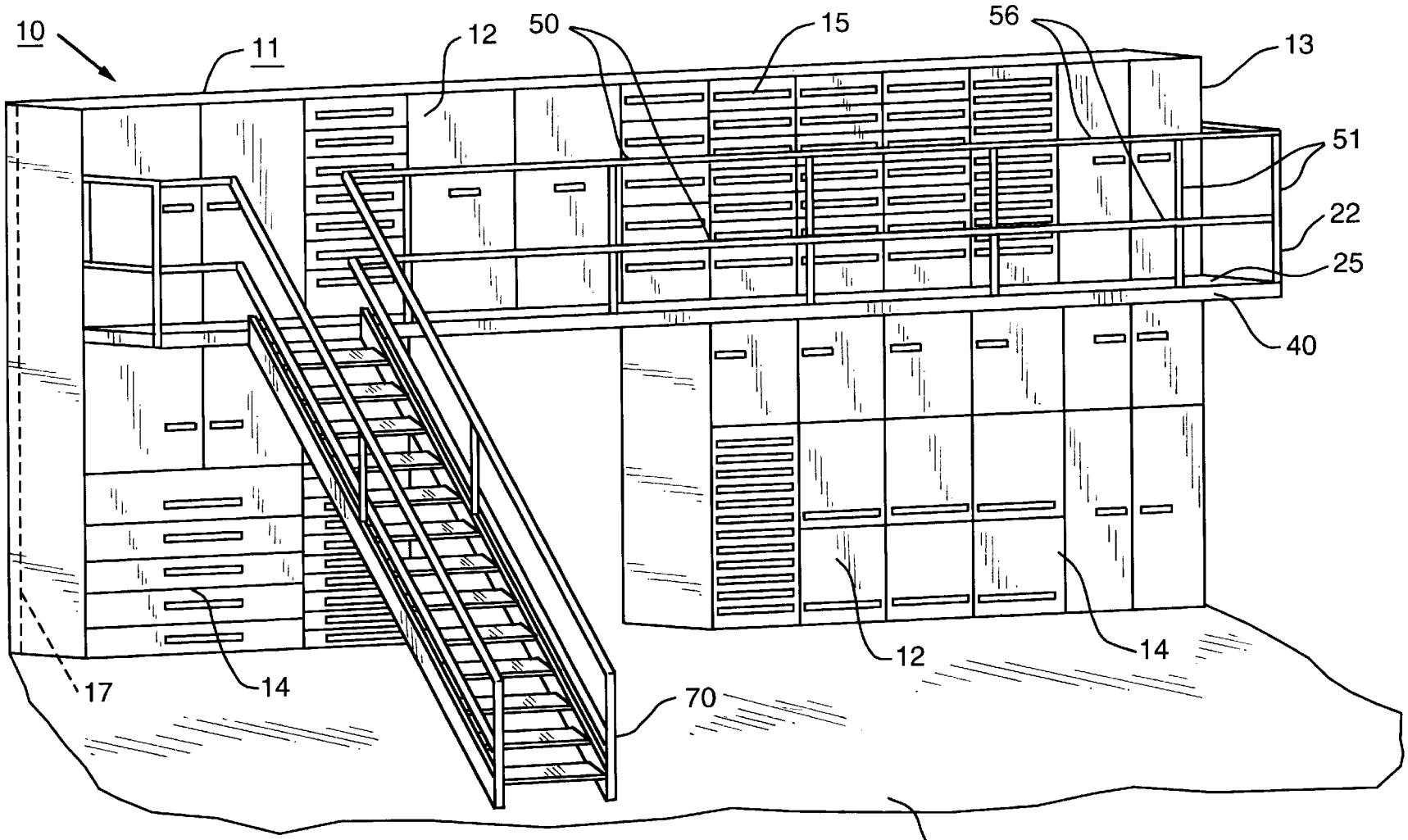
FIG. 1 is a perspective view showing one embodiment of the storage structure with mezzanine access of the present invention.

An embodiment of the modularly assembled combination storage structure with mezzanine access of the present invention is shown wherein the storage structure 11 is comprised of a row of stacked storage cabinets 12 (some of the drawer type and others of the door type access) stacked on top of each to a predetermined height 13, thereby providing base storage cabinets 14 and upper storage cabinets 15.

The stacked storage cabinets 12 illustrated are steel cabinet structures having internal supporting structural steel framework.

The structural framework of each cabinet 12 includes vertical front beams 16 and vertical back beams 17 and horizontal side beams 18. These steel beams of the structural frame work of each cabinet are interwelded with each other and with the steel skin of each cabinet so that each cabinet is provided in modular form. The frameworks of the storage stacked cabinets 12 are also interconnected with fasteners in the form of bolts 20 provided on the inside bottom corners of each upper cabinet 15, with the bolts thereby passing through the floor of each cabinet and being received and interconnected to the internal frame structure of a respective underlying base cabinet 14 of the stack.

The vertical back beams 17 of the base cabinets 14 are rigidly secured to underlying supporting floor 21 by conventional fastening systems which will securely retain the framework to the concrete supporting floor structure 21. This connection of the back vertical beams to the supporting floor structure is necessary in order to support the mezzanine structure 22 in cantilever fashion from the storage structure 11 without tipping over the storage structure 11 when personnel and structural weight is applied to the mezzanine structure 22.

Figure 2:
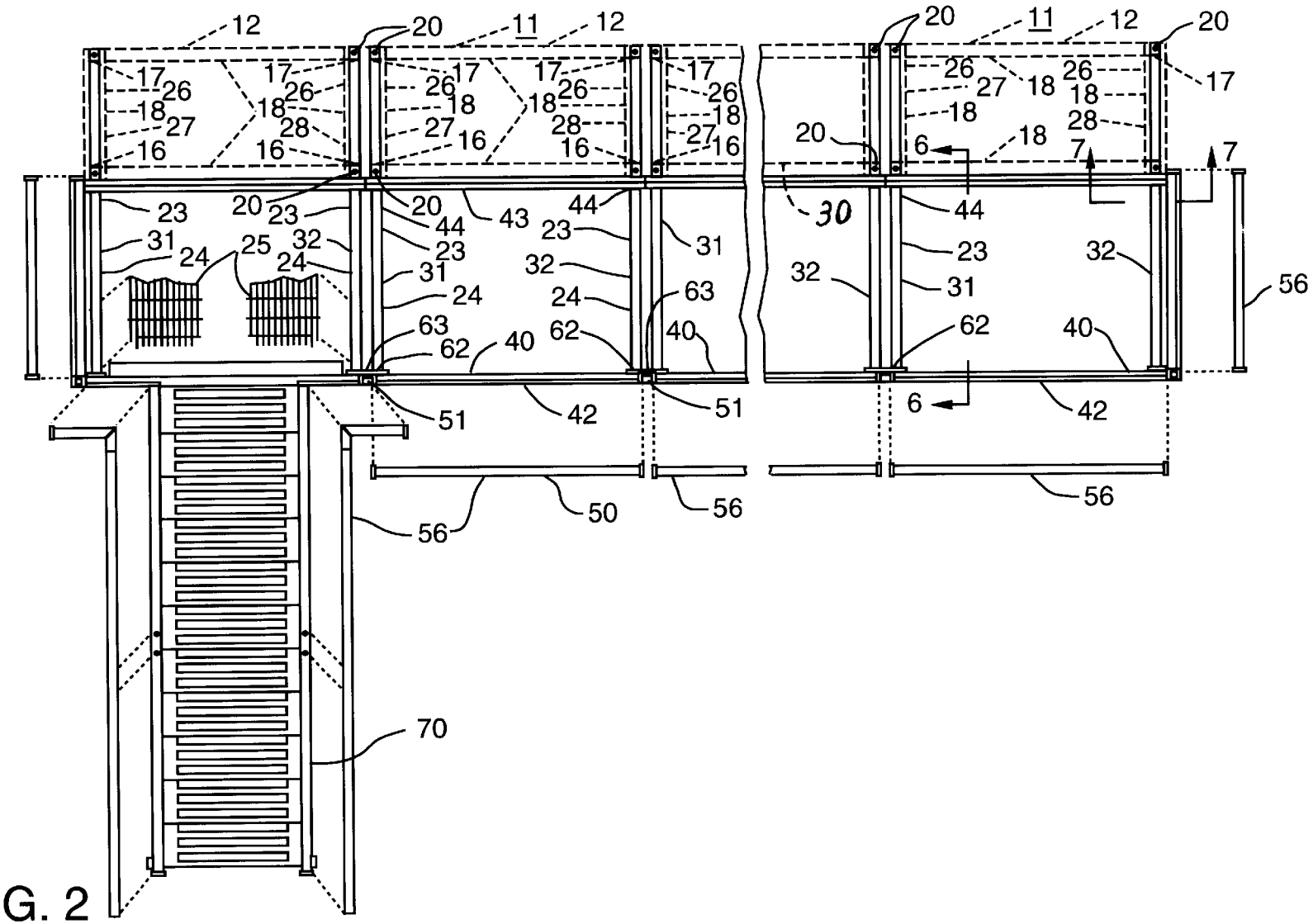
FIG. 2 is a plan view of the storage structure with mezzanine access shown in FIG. 1 with central portions sectioned away and the cabinet structures removed and the mezzanine decking and railing system illustrated in exploded view form for clarification and for illustrating the modular assembly of the mezzanine structure.
Figure 3:
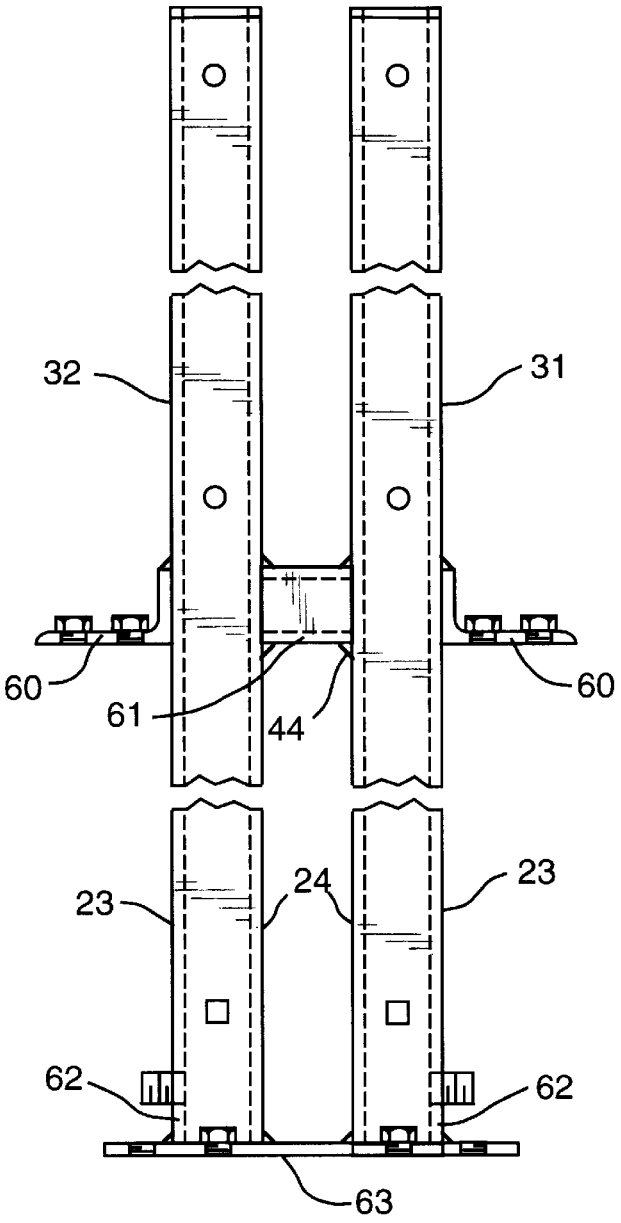
FIG. 3 is an enlarged plan view of the cantilever intermediate deck support beams shown in FIG. 2 for supporting the mezzanine deck.
Figure 4:
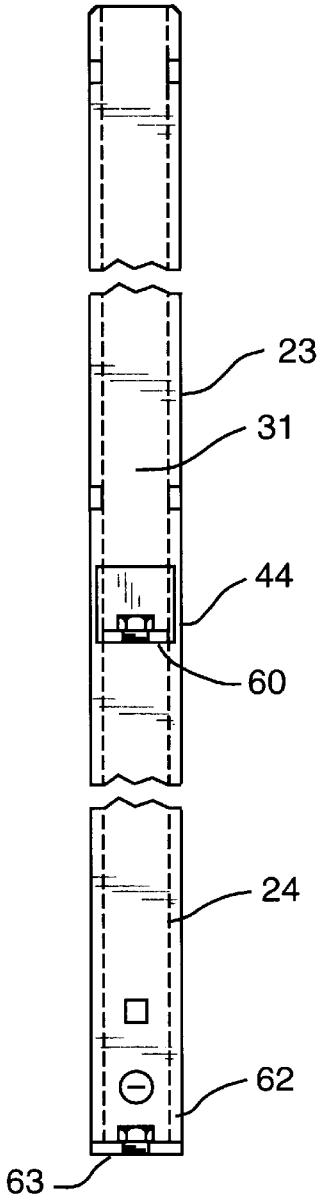
FIG. 4 is a right side view of the cantilever beam structure shown in FIG. 3.
Figure 5:
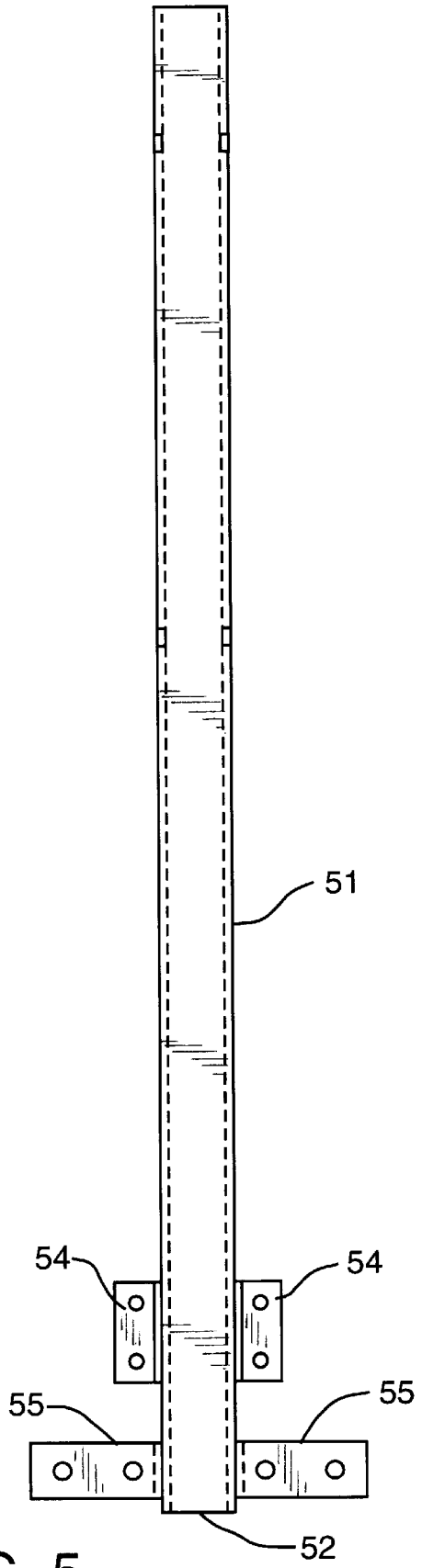
FIG. 5 is an enlarged view in vertical front elevation showing one of the intermediate support post or balusters of the mezzanine structure shown in FIG. 2.

The mezzanine structure 22 utilizes a plurality of spaced horizontally aligned cantilever beams 23 of predetermined length as best illustrated in FIGS. 2, 3 and 4, which penetrate the storage structure 11 and are respectively (indirectly) connected to selected of the front and back vertical beams 16 and 17.

Forward ends of the cantilever beams 23 extend beyond vertical front beams 16 and front face of cabinet structure 11 with overhangs 24 for cantilevered support thereon of mezzanine decking 25, which are metal grate sections. Decking 25 is supported on beam overhangs 24 for mezzanine access to upper storage cabinets 15.

Horizontal side beams 18 include left and right hollow metal beams 26 which are C-shaped steel channels that receive cantilever beams 23 therein.

These hollow beams 26 are provided in pairs or in a pair as left and right side horizontal channels 27 and 28 respectively for each modular or independent stacked storage cabinet 12. These hollow left and right side channels 27 and 28 form part of a pallet foot 30 provided as a base for each of the stacked storage cabinets 12. In other words, the horizontal bottom support structures or channels 18 of each cabinet 11 in fact also provide a dual function as serving as a pallet foot for lifting and maneuvering the cabinets with a forklift or other appropriate machinery.

These spaced pairs 27 and 28 of side C channels of each upper cabinet 15 thereby retain adjacent pairs of cantilever beams 31 and 32 respectively with their overhangs 24.

Figure 6:
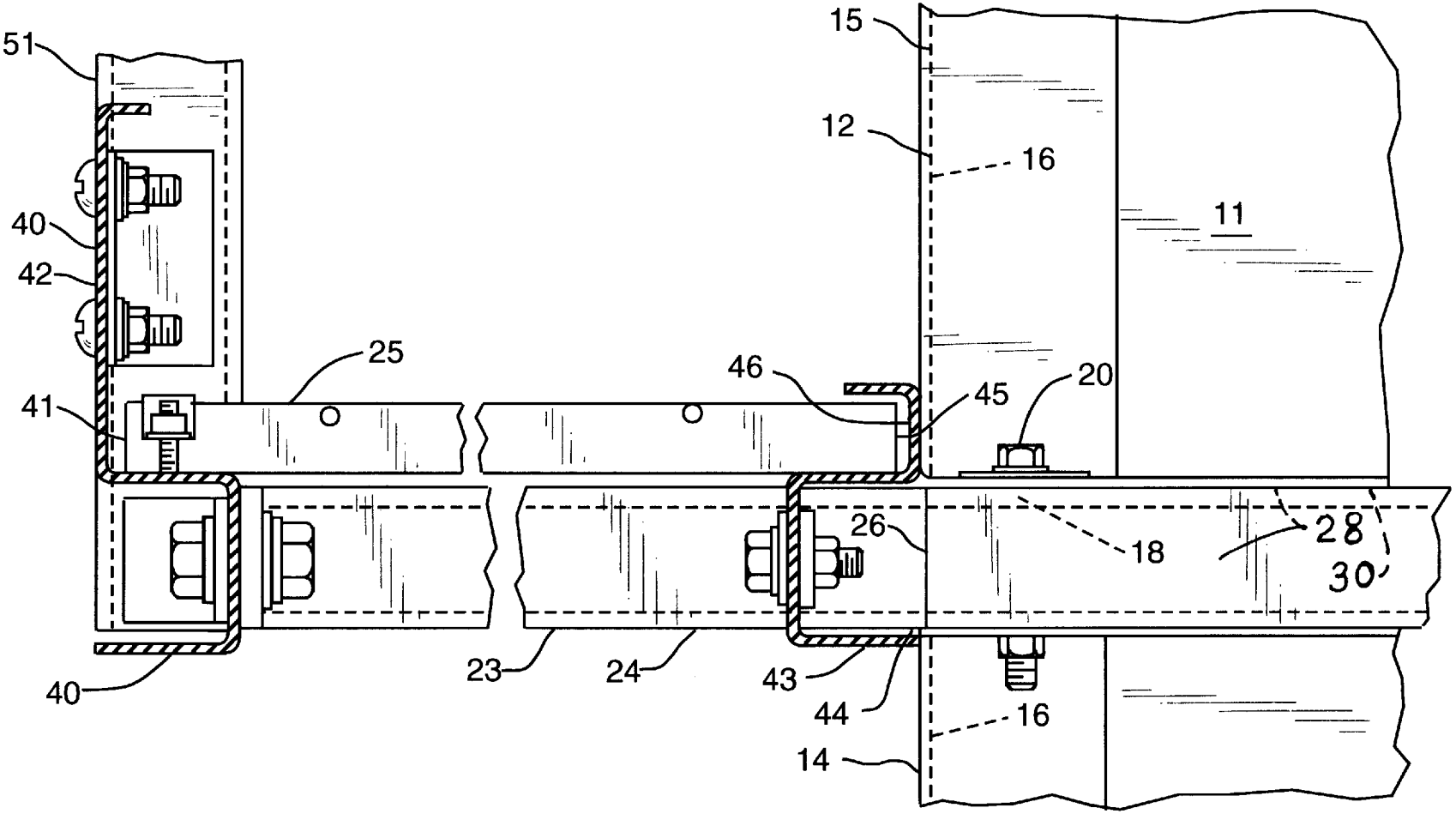
FIG. 6 is a view in vertical cross section of the mezzanine structure shown in FIG. 2 as seen along section line 6—6.
Figure 7:
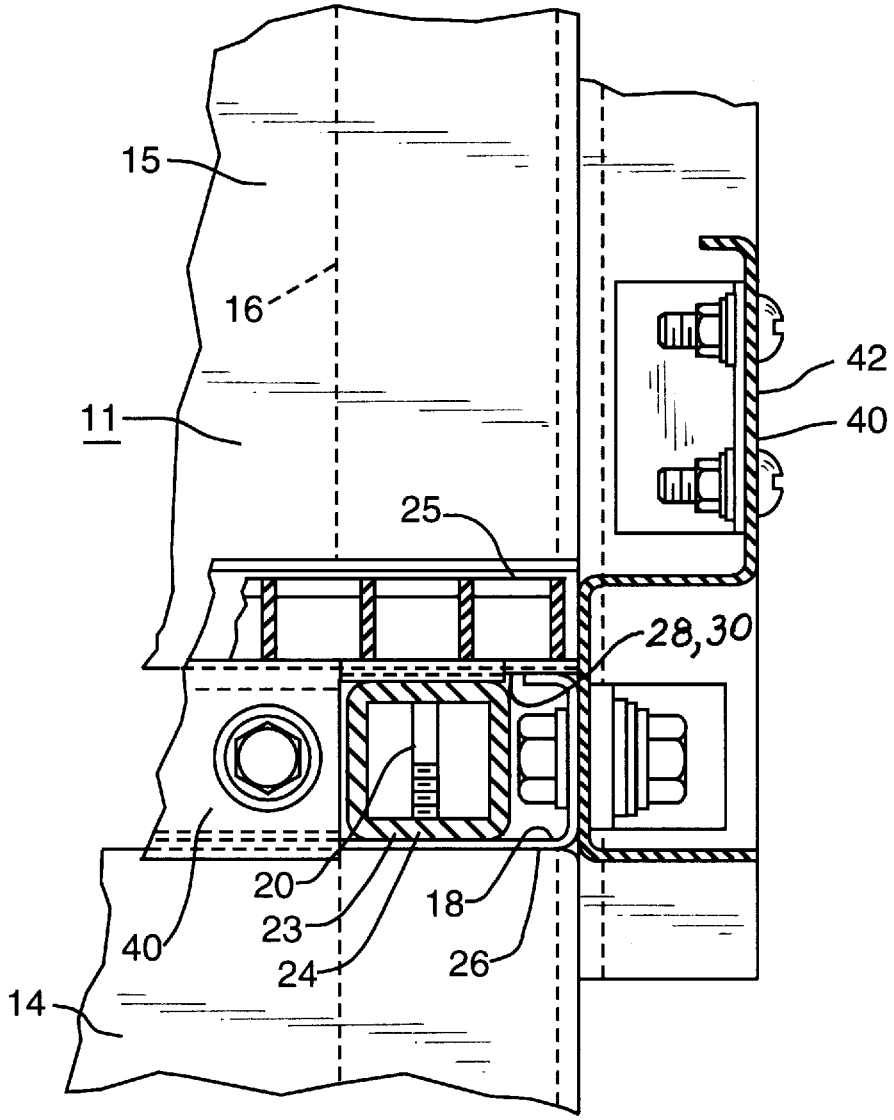
FIG. 7 is a view in vertical cross section of the mezzanine structure shown in FIG. 2 as seen along section line 7—7.

Fasteners 20 additionally serve to secure side C channels 27 and 28 with coextending portions of cantilever beams 23 together, as well as to tie all of the framework structure of the storage structure 11 together. This indirectly provides connection of cantilever beams to front and back vertical beams 16 and 17. In other words, horizontal cantilever beams 23 protrude fully into hollow beams 26 from front vertical beams 16 to back vertical beams 17 to provide full cantilever support of beam overhangs 24, which support mezzanine decking 25. In particular, note FIGS. 2, 6 and 7.

The decking 25 is provided in sections which respectively span adjacent pairs 31 and 32 of cantilever beam overhangs 24. Toe rail channels 40 support outer edges 41 of deck sections 25. Toe channels 40 include an upwardly extending and coextending toe rail 42.

S-shaped base rail channels 43 are secured between proximal ends 44 of adjacent pairs 31 and 32 of cantilever beam overhangs 24. S-shaped base rail channel sections 43 support inner edges 45 of deck sections 25 respectively. Edges 45 of deck sections 25 are received within a channel 46 of S-shaped base rail channels 43.

A sectioned hand railing system 50 is provided which has baluster posts 51 with bottom portions 52 respectively interconnected with adjacent of the beam overhangs 24 and toe rails 40 between adjacent of cantilever beam overhangs 32 and 31 between deck sections 25. This is accomplished by the use of conventional bolting of welded baluster toe rail connecting ears 54 and bottom cantilever overhang beam connecting ears 55 which are also welded to the bottom portion 52 of balusters 51.

Hand rails 56 are provided in sections which span and are secured to the upper and mid portions of balusters 51.

In addition, the adjacent proximal ends 44 of overhangs 24 of cantilever beams 23 and adjacent base rail channels 43 between adjacent deck section pairs 32 and 31 of overhangs 24 are also interconnected so that the entire mezzanine structure is completely tied together as a unit, even though originally supplied in modular form. This connection is accomplished by ears 60 which are welded to adjacent cantilever beams 32 and 31 between mezzanine deck sections which are bolted in conventional fashion to inner channel 43. Extra rigidity between the modular mezzanine structure sections is also provided by the welding of brace 61 between adjacent cantilever beams 32 and 31. These welded combinations are of course completed prior to assembly of the mezzanine structure 22 with the storage structure 11 as preassembled parts.

Distal ends 62 of adjacent overhangs 24 provided between deck sections 25 on adjacent cantilever beams 32 and 31 are also secured together by plate 63 which is there welded to both proximal ends 62 of overhangs 24. Plate 63 is secured to toe rails 40 along with the same bolting mechanism which secures balusters 51 through the use of bottom baluster attaching ears 55. They all bolt together at the same time thereby providing a rigid unitary structure.

A stairway 70 is then attached to the mezzanine structure 22 to provide access from the underlying supporting floor 21. The stairway structure 70 may be attached at any point to the mezzanine structure 22. The stairs may protrude off of either end of the mezzanine structure 22 either in line or at right angles to the mezzanine structure, or the stairway may come off of the front face of the mezzanine structure 22 as illustrated in the figures.

The completed combination structure has no, and requires no, vertical support poles or any other support mechanism to support the cantilevered mezzanine 22 from the cabinet structure 11.

In addition, the mezzanine structure may also be readily used on cabinet structures 11 which have centrally located gaps in the lower cabinet structures 14 to provide for a doorway as illustrated in FIG. 1.

Thin lighting fixtures may also be mounted up underneath and against the bottom sides of the mezzanine decking 25 and electrical wiring supplied thereto through conventional electrical conduit and the hollow beam overhangs 24.

I claim:

1. A storage structure with mezzanine access, the storage structure comprising a row of storage cabinets stacked on top of each other to a predetermined height and thereby providing base and upper storage cabinets, said storage cabinets having internal supporting structural framework including vertical front and back beams and horizontal side beams with the frameworks of said stacked cabinets interconnected and said vertical back beams of the base cabinets secured to an underlying supporting floor, a mezzanine comprising a plurality of spaced horizontally aligned cantilever beams of predetermined length penetrating said storage structure and respectively connected to selected ones of said front and back vertical beams and extending beyond said vertical front beams with overhangs for cantilevered support thereon of a mezzanine deck, and decking supported on said beam overhangs for mezzanine access to said upper storage cabinets.

2. The storage structure of claim 1 wherein said horizontal side beams include hollow metal beams and said cantilever beams are received in selected ones of said hollow beams.

3. The storage structure of claim 2 wherein said side hollow beams are a pair of spaced side channels forming part of a pallet foot provided as a base for each of said storage cabinets and which thereby retain adjacent pairs of said cantilever beams with their overhangs.

4. The storage structure of claim 3 including fasteners securing said channels and coextending portions of said cantilever beams together.

5. The storage structure of claim 4 wherein said decking is provided in sections which respectively span said adjacent pairs of cantilever beam overhangs.

6. The storage structure of claim 5 including toe rail channels secured between distal ends of said adjacent pairs of cantilever beam overhangs.

7. The storage structure of claim 6 wherein said toe rail channels support outer edges of said deck sections which rest on said toe rail channels.

8. The storage structure of claim 7 wherein said toe rail channels include an upwardly extending and coextending toe rail.

9. The storage structure of claim 7 including S-shaped base rail channels secured between proximal ends of said adjacent pairs of cantilever beam overhangs and supporting inner edges of said deck sections respectively received within a channel of said S-shaped base rail channels.

10. The storage structure of claim 7 including a sectioned hand railing system having balusters with bottom portions respectively interconnected with adjacent ones of said beam overhangs and toe rails between adjacent ones of said pairs of cantilever beam overhangs, and hand rails spanning and secured to upper portions of said balusters.

11. The storage structure of claim 10 wherein adjacent proximal ends of said overhangs and base rail channels between said adjacent pairs of said overhangs are interconnected.

12. The storage structure claim 11 including a stairway attached to said mezzanine for access from said supporting floor.

13. A method of providing a storage structure with mezzanine access, the storage structure comprising a row of storage cabinets stacked on top of each other to a predetermined height and thereby providing base and upper storage cabinets, said storage cabinets having an internal supporting structural framework including vertical front and back beams and horizontal side beams, said method comprising the steps of: interconnecting the frameworks of stacked cabinets, securing said vertical back beams of said base cabinets to an underlying supporting floor, providing a plurality of spaced horizontally aligned cantilever beams of predetermined length, penetrating said cantilever beams into a front face of said storage structure and respectively securing said cantilever beams to selected ones of said front and back vertical beams with overhangs of said cantilever beams extending beyond said front face for cantilevered support thereon of a mezzanine deck, and assembling decking on said cantilever beam overhangs for mezzanine access to said upper storage cabinets.

14. The method of claim 13 wherein said horizontal side beams are a pair of hollow spaced side beams forming part of a pallet foot provided as a base for each of said storage cabinets, the steps of penetrating said cantilever beams and respectively securing said cantilever beams being carried out by inserting said cantilever beams into said hollow beams and securing them to said hollow beams with fasteners.

15. The method of claim 13 wherein said decking is assembled in sections which span adjacent pairs of said cantilever beam overhangs.

16. The method of claim 15 including the step of securing toe rails and base rails respectively between adjacent pairs of distal and proximal ends of the cantilever beam overhangs and supporting outer and inner edges of said deck sections on said rails.

17. The method of claim 16 including the step of securing railing balusters to said distal ends and toe rails between adjacent pair sets thereof.

18. The method of claim 17 including the step of securing a stairway to said mezzanine for access thereto from said floor.

* * * * *